US012808196B2

(12) United States Patent
Engel

(10) Patent No.: US 12,808,196 B2
(45) Date of Patent: Nov. 24, 2026

(54) CROSS-VENTILATED COLD ROOF SYSTEM AND METHOD FOR USING SAME

(71) Applicant: Twilight Roofing, LLC, Bozeman, MT (US)

(72) Inventor: Nathan Lee Engel, Bozeman, MT (US)

( * ) Notice: Subject to any disclaimer, the term of this patent is extended or adjusted under 35 U.S.C. 154(b) by 168 days.

(21) Appl. No.: 19/036,666

(22) Filed: Jan. 24, 2025

(65) Prior Publication Data

US 2026/0218516 A1 Jul. 30, 2026

(51) Int. Cl.
*E04D 13/17* (2006.01)
*E04B 2/28* (2006.01)

(52) U.S. Cl.
CPC ..... *E04D 13/172* (2013.01); *E04B 2/28* (2013.01)

(58) Field of Classification Search
CPC ..... E04D 13/17; E04D 13/172; E04B 2/28
See application file for complete search history.

(56) References Cited

U.S. PATENT DOCUMENTS 1,928,034 A * 9/1933 Schulstadt ..... E04B 1/86 181/290
4,064,300 A * 12/1977 Bhangu ..... F28F 3/12 428/129
4,351,873 A * 9/1982 Davis ..... E04B 1/80 428/317.1
4,899,514 A 2/1990 Brookhart, Jr.
6,877,288 B2 * 4/2005 Shirota ..... E04D 5/12 52/302.1
8,615,945 B2 12/2013 Walker
8,776,450 B2 * 7/2014 Lee ..... E04D 13/076 52/95
9,604,428 B2 * 3/2017 Walker ..... B29D 28/00
D1,112,843 S * 2/2026 Engel ..... D25/138
(Continued)

FOREIGN PATENT DOCUMENTS

JP H 0734614 A 2/1995
JP 4743907 B2 8/2011
(Continued)

OTHER PUBLICATIONS

Cool-vent, Source: https://www.hunterpanels.com/products/roof-products/cool-vent/ Date Accessed: Dec. 11, 2024.
(Continued)

*Primary Examiner* — Andrew J Triggs
(74) *Attorney, Agent, or Firm* — Antoinette M. Tease

(57) ABSTRACT

A cross-ventilated cold roof system with eight supporting blocks on the underside of each roof panel. Each roof panel has three longitudinal sections and four lateral sections. The supporting blocks are arranged so that four supporting blocks are situated in the middle longitudinal panel and four supporting blocks are situated in a third longitudinal section along the rear of the roof panel. The supporting blocks are also configured so that each supporting block lies on top of the dividing line between adjacent lateral sections. The supporting blocks are spaced equally (laterally) and offset so that two of the supporting blocks extend partially off of one side edge of the roof panel. Four of the supporting blocks extend partially beyond the rear edge of the roof panel. A method of installing a cross-ventilated cold roof system using the roof panels described above.

4 Claims, 15 Drawing Sheets

(56) References Cited

U.S. PATENT DOCUMENTS

| | | | | |
|---|---|---|---|---|
| 2006/0179748 | A1 | 8/2006 | Schmidt | |
| 2006/0230707 | A1* | 10/2006 | Roe | E04D 13/172 52/794.1 |
| 2010/0279065 | A1* | 11/2010 | Schroer | B32B 33/00 156/60 |
| 2015/0096248 | A1* | 4/2015 | Tebo | E04F 13/007 52/302.3 |
| 2015/0176283 | A1* | 6/2015 | Smiley, Jr. | E04D 13/172 52/302.1 |
| 2017/0044769 | A1* | 2/2017 | Fritz | B32B 5/024 |

FOREIGN PATENT DOCUMENTS

| | | | |
|---|---|---|---|
| JP | 5105628 | B2 | 12/2012 |
| JP | 2017075523 | A | 4/2017 |
| JP | 7531811 | B2 | 8/2024 |
| NL | 8700789 | A | 11/1987 |
| WO | WO 1006/018781 | A1 | 6/1996 |

OTHER PUBLICATIONS

Nail Base Roof Insulation Panels, Source: https://documents.gaf.com/data-sheets/thermacal-roof-insulation-panels-resgn425-%288-23%29-_data-sheet.pd Date Accessed: Dec. 11, 2024.

* cited by examiner

CROSS-VENTILATED COLD ROOF SYSTEM AND METHOD FOR USING SAME

BACKGROUND OF THE INVENTION

1. Field of the Invention

The present invention relates generally to the field of roofing systems, and more particularly, to a panelized cold roofing system that provides for optimized cross-ventilation and ease of installation without an insulation layer.

2. Description of the Related Art

The vast majority of roofing systems in North America are "cold roof" designs. A "cold roof" is one in which the structural roof framing is primarily outside of the building's thermal envelope, whereas a "warm roof" is one in which the structural roof framing is situated inside of the building's thermal envelope. In a cold roof design, interior finishing and insulation layers are separated from the structural framing by a ventilation channel that allows exterior air to circulate through the roofing assembly. AK House Project, accessed at https://akhouseproject.com/cold-roofs-vs-warm-roofs/ on Dec. 22, 2024. Generally speaking, cold roof systems are preferable when it is desirable to avoid moisture accumulation and accompanying mold proliferation. Until the present invention, however, all panelized cold roof systems included some form of an insulation layer.

The present invention is a panelized cross-ventilated cold roof system that has been optimized for operation in both cold and warm climates without the need for insulation. In cold climates, the present invention allows heat from the building to escape through the roof before it can melt snow that has accumulated on top of the roof, thereby mitigating the buildup of ice dams and icicles, which may cause personal injury or property damage, and eliminating the need for shoveling snow off of the roof. In warm climates, the present invention creates a cross-ventilated air space under the roofline that allows the heat from the sun to escape before it is transferred into the building, thereby reducing indoor temperatures and reducing cooling costs.

U.S. Pat. No. 8,615,945 (Walker, 2013) is an example of a system and method of ventilated structural panels. In this particular invention, a multi-plenum structural panel is comprised of top, middle and bottom sheets. Spacing structural elements are fixedly attached to and situated in between the top and middle sheets and the middle and bottom sheets, thereby creating a lower plenum between the bottom and middle sheets and an upper plenum between the middle and top sheets. The spacing structural elements create pathways for air to move within the plenums. The concept of using spacing elements to create pathways for air is not new, but the particular configuration and assembly method of the present invention are novel.

U.S. Pat. No. 4,899,514 (Brookhart, Jr., 1990) provides a ballast block in which the end portions of each block are interlinked in an overlapping relationship with the corresponding end portions of similar ballast blocks. The ballast block of this particular invention was intended for use in single-ply roofing construction. The purpose of the interlinked ends of the ballast blocks is to prevent uplift and rotational displacement due to wind forces. The ballast blocks are used to protect and secure the single-ply waterproof membrane that is laid down on top of the insulation layer. The present invention does not include an insulation layer, but it does utilize overlapping end pieces, together with markings on the roof panels, for quick and accurate installation.

U.S. Patent Application Pub. No. 20060179748 (Schmidt) discloses vented insultation for use in nail-based constructions. As described in this patent, conventional cold roof construction involves mounting a plurality of spacers on top of a flat rigid sheet of insulation, with the spacers being configured as rails that extend the length of the sheet of insulation. A layer of plywood is then situated on top of the rails, and the roof rests on top of the plywood, thereby creating channels between the sheet of insulation and the roof for air to flow through. Schmidt's invention includes a plurality of nodes that extend upwardly from a first surface of the sheet of insulation to define a plurality of first ventilation channels and a plurality of second ventilation channels. Although the present invention uses blocks to create pathways for air ventilation, it does not incorporate any insulation layer whatsoever. As far as the inventor is aware, the present invention is the only uninsulated cold roof panel system on the market today.

Insulated cold roof panels are relatively expensive and time-consuming to install. Furthermore, the long screws required to install the insulated roof panels can compress the layer of foam insulation, making it difficult to ensure that abutting edges between panels are flat and/or aligned properly. The present invention can be installed with a standard framing nail gun using 3.5" ring shank framing nails, which greatly reduces the cost and increases the speed of installation. The blocking on the present invention is specifically configured so that it spans all sheathing joints, ensuring that all joints are flat and smooth. The blocking is also specifically sized and oriented to maximize airflow while maintaining structural support.

BRIEF SUMMARY OF THE INVENTION

A cross-ventilated cold roof system comprising: a plurality of roof panels; wherein each roof panel is comprised of a plywood sheet and eight supporting blocks that are fixedly attached to an underside of the plywood sheet; wherein the supporting blocks are arranged on the underside of the plywood sheet as follows: wherein each roof panel is divided longitudinally into three equal longitudinal sections, a first longitudinal section being situated across a front end of the roof panel, a second longitudinal section being situated across a center of the roof panel, and a third longitudinal section being situated across a rear end of the roof panel; wherein four supporting blocks are attached to the underside of the plywood sheet in the second longitudinal section; wherein four supporting blocks are attached to the underside of the plywood sheet in the third longitudinal section such that a first half of each supporting block measured along a lateral axis of the supporting block is attached to the underside of the plywood sheet and a second half of each supporting block measured along the lateral axis of the supporting block extends outwardly from a rear edge of the roof panel; wherein each roof panel is divided laterally into four equal lateral sections, a first lateral section being situated along a first side edge of the roof panel, a second lateral section being situated adjacent to the first lateral section, a third lateral section being situated adjacent to the second lateral section, and a fourth lateral section being situated along a second side edge of the roof panel; wherein three of the four supporting blocks that are situated in the second longitudinal section are situated along a dividing line between adjacent lateral sections, and a fourth block of the four supporting blocks that are situated in the second longitudinal section is situated such that a longitudinal axis of the fourth block in the second longitudinal section is aligned with the second side edge of the roof panel; and wherein three of the four supporting blocks that are situated in the third longitudinal section are situated along a dividing line between adjacent lateral sections, and a fourth block of the four supporting blocks that are situated in the third longitudinal section is situated such that a longitudinal axis of the fourth block in the third longitudinal section is aligned with the second side edge of the roof panel.

In a preferred embodiment, each roof panel comprises a plurality of markings that are configured to correspond to the supporting blocks that are fixedly attached to the underside of the roof panel. The markings on a first roof panel preferably include markings that correspond to the supporting blocks on a second roof panel adjacent to the front end of the first roof panel and markings that correspond to the supporting blocks on a third roof panel adjacent to the first side edge of the first roof panel.

The present invention is also a method of installing a cross-ventilated cold roof system comprising: installing a plurality of supporting blocks around a perimeter of a section of roof; installing the plurality of roof panels of claim 1 in a plurality of rows; staggering the rows of roof panels so that adjacent side edges of the roof panels are offset in one row relative to an adjoining row; and removing supporting blocks from the plurality of roof panels as needed to avoid overlap with the supporting blocks around the perimeter of the section of roof. In a preferred embodiment, an underlayment with outer edges underlies the plurality of supporting blocks, and the supporting blocks that are arranged around the perimeter of the section of roof extend beyond the outer edges of the under underlayment.

In another preferred embodiment, the underlayment is a layer of shingles comprised of a series of high points, and the supporting blocks that are fixedly attached to the underside of the plywood sheet are configured to span at least two high points on the layer of shingles. In yet another preferred embodiment, the method of the present invention further comprises: installing a plurality of supporting blocks along a roof valley, providing a plurality of the roof panels of claim 1 for installation along the roof valley; wherein each of the plurality of the roof panels that is provided for installation along the roof valley comprises a first half and a second half, cutting the first half of each of the roof panels along a forty-five-degree angle; and installing the cut roof panels along the roof valley.

REFERENCE NUMBERS

1 Roof panel
2 Plywood sheet
3 Supporting block
4 Second side edge (of plywood sheet)
5 Rear edge (of plywood sheet)
6 Front edge (of plywood sheet)
7 First side edge (of plywood sheet)
8 Markings
9 Underlayment
10 Corner piece
11 Truss

DETAILED DESCRIPTION OF INVENTION

Figure 1:
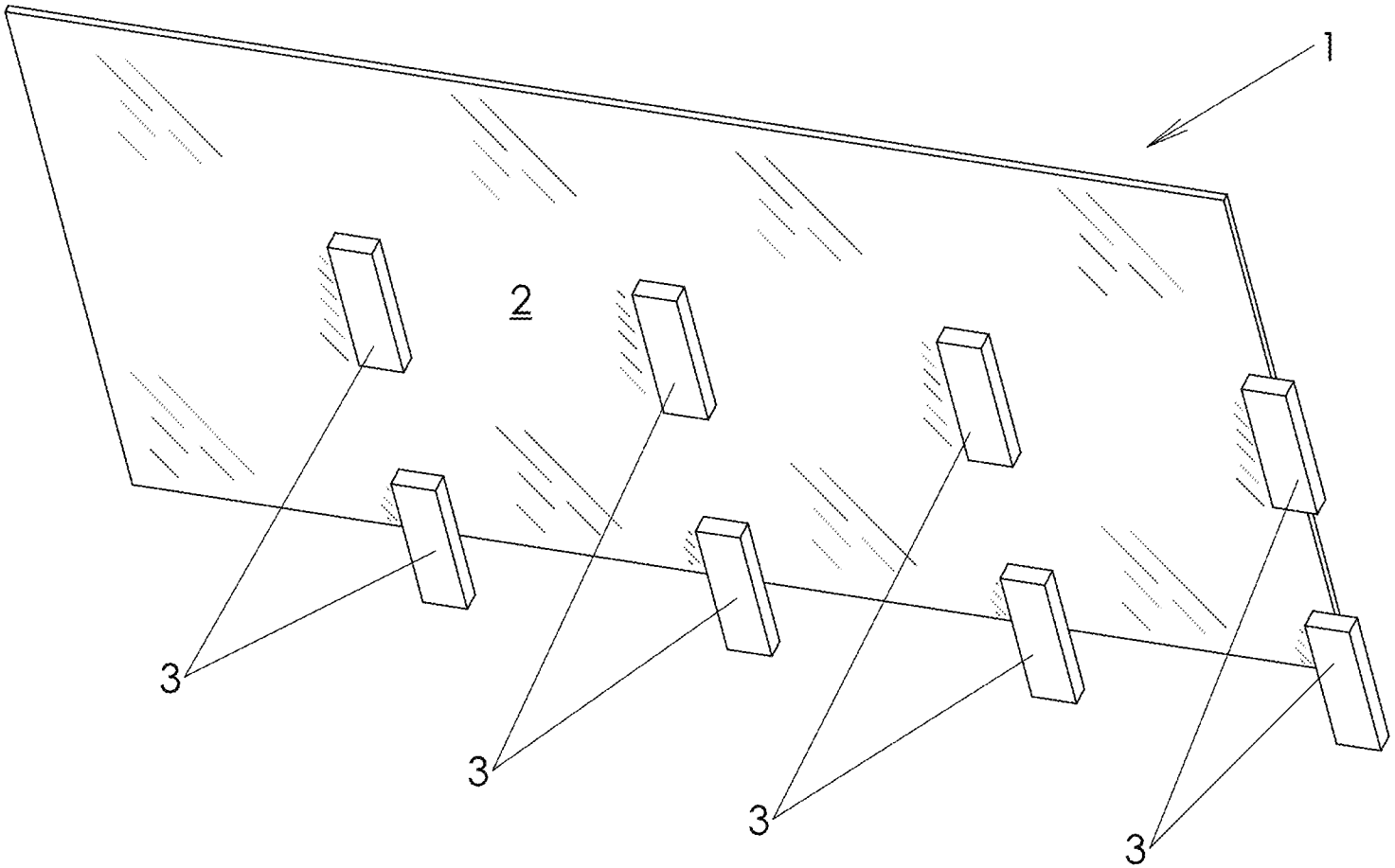
FIG. 1 is a bottom perspective view of a single roof panel of the present invention.

FIG. 1 is a bottom perspective view of a single roof panel of the present invention. The present invention is comprised of a plurality of roof panels that are installed in a particular manner to create a cross-ventilated cold roof system. As shown in FIG. 1, each roof panel 1 is comprised of a single plywood sheet 2 and eight supporting blocks 3 arranged in a particular configuration on the bottom surface of the roof panel 1. In a preferred embodiment, the plywood sheet 2 is a 4'×8' sheet of oriented strand board (OSB) or C-D exposure (CDX) plywood, and the supporting blocks 3 are 3.5" width×12" length×1.5" diameter blocks that are pre-attached to the underside of the plywood sheet.

Figure 2:
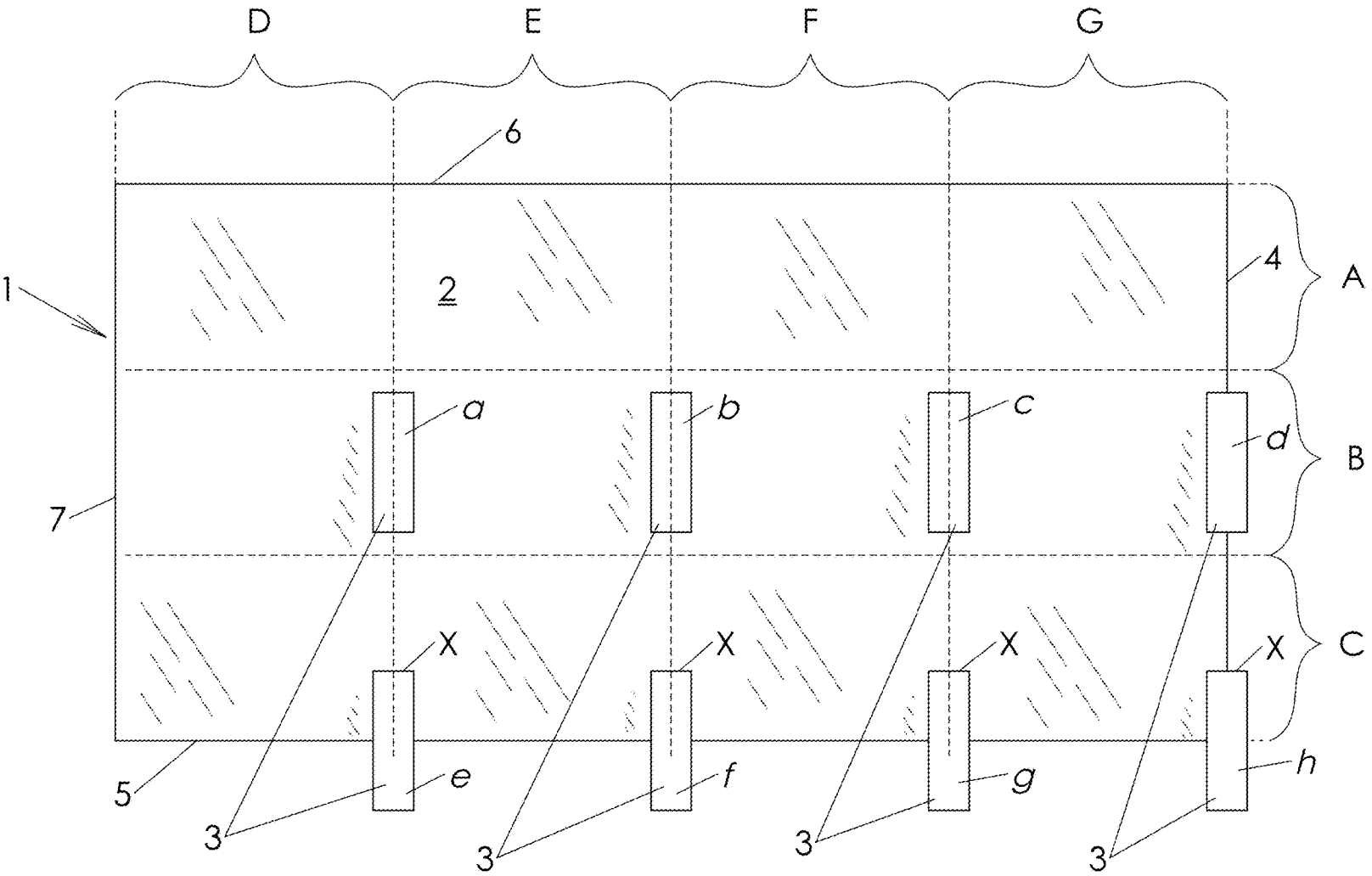
FIG. 2 is a bottom view of a single roof panel of the present invention.
Figure 7:
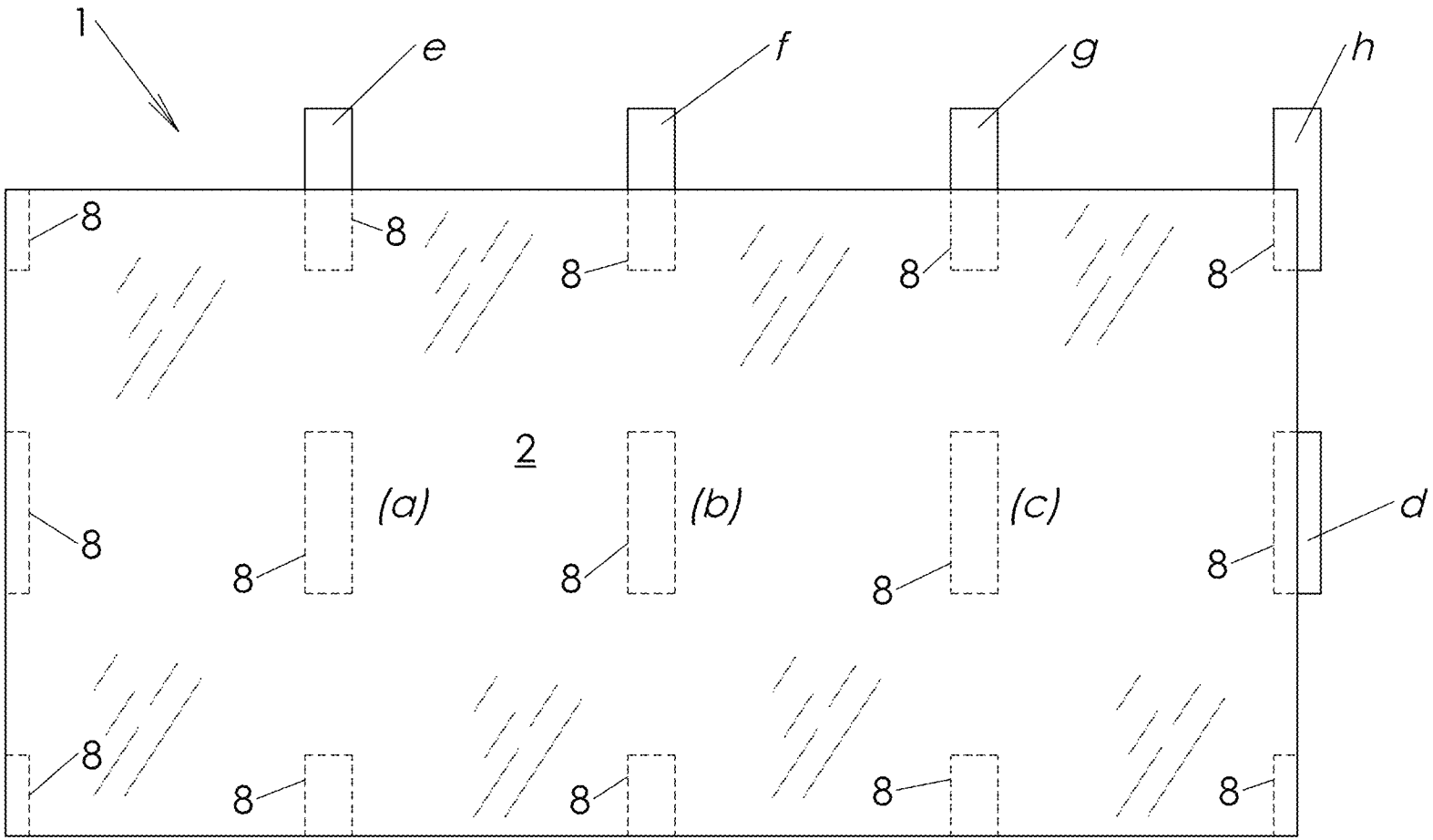
FIG. 7 is a top view of a single roof panel of the present invention.
Figure 8:
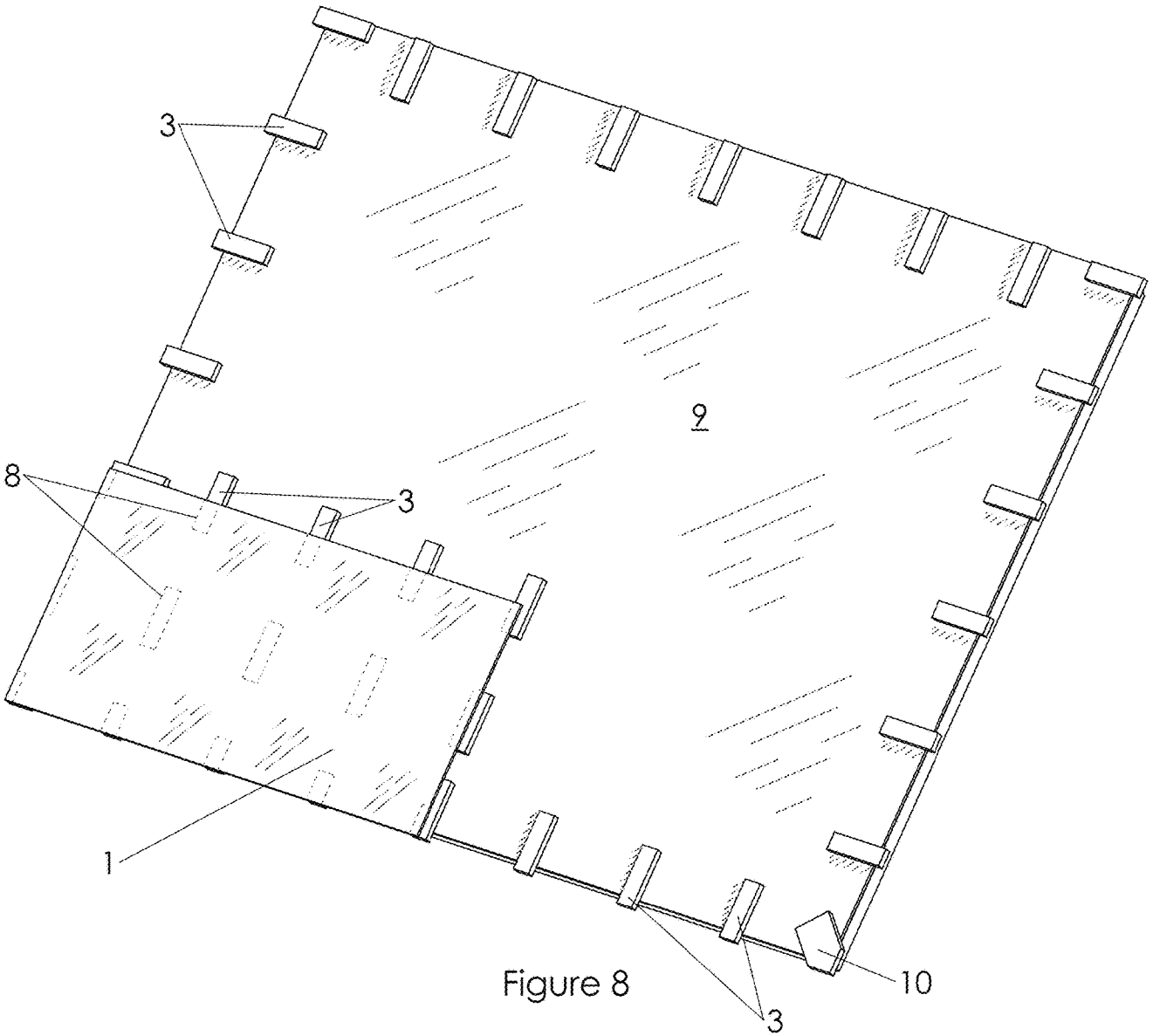
FIG. 8 is a top perspective view of a section of roof showing the installation of the first roof panel.

FIG. 2 is a bottom view of a single roof panel of the present invention. As shown in this figure, each panel 1 is divided longitudinally into three equal sections. In this figure, these sections are labeled as A, B and C, respectively. Section A is situated at the top of this figure, section B is situated in the center of this figure, and section C is situated at the bottom of this figure. There are no supporting blocks 3 in Section A. Four supporting blocks 3 are fully attached to the plywood sheet 2 in Section B, and four supporting blocks are partially attached to the plywood sheet 2 in Section C. The supporting blocks 3 in Section C are attached so that half of the supporting block 3 (measured along the lateral axis of the block) is attached to the underside of the plywood sheet 2, and the other half of the supporting block extends off of the plywood sheet 2. Note that in this figure, the top of this figure corresponds to the front of the panel (see FIG. 3), and the bottom of this figure corresponds to the rear of the panel (see FIG. 4). In FIG. 8 the front of the panel faces downward (similar to FIG. 7), and the rear of the panel faces upward. In FIG. 7, section A would be at the bottom of the figure, section B would be in the middle, and section C would be at the top of the figure.

The panel 1 is also divided laterally into four equal sections, which are labelled as D, E, F and G, respectively, in FIG. 2. For case of reference, the eight supporting blocks 3 are labeled as a-h on FIG. 2. Supporting block a is situated in the center of section B and on the dividing line between sections D and E. Supporting block b is situated in the center of section B and on the dividing line between sections E and F. Supporting block c is situated in the center of section B and on the dividing line between sections F and G. Supporting block d is situated in the center of Section B with the central longitudinal axis of supporting block d in alignment with and directly on top of a second side edge 4 of the plywood sheet 2, such that half of supporting block d extends past the second side edge 4 and is unsupported by the plywood sheet 2. The first side edge (unlabeled) of the plywood sheet 2 is on the left-hand side of this figure.

Supporting block e is situated on the dividing line between sections D and E with the top edge (designated as "X" in FIG. 2) of the block in the center of Section C so that the bottom half of the supporting block 3 extends past the rear edge 5 of the plywood sheet 2 and is uncovered by the plywood sheet 2. Supporting block/is situated on the dividing line between sections E and F with the top edge (designated as "X" in FIG. 2) of the block in the center of Section C so that the bottom half of the supporting block 3 extends past the rear edge 5 of the plywood sheet 2 and is uncovered by the plywood sheet 2.

Supporting block g is situated on the dividing line between sections E and F with the top edge (designated as "X" in FIG. 2) of the block in the center of Section C so that the bottom half of the supporting block 3 extends past the rear edge 5 of the plywood sheet 2 and is uncovered by the plywood sheet 2. Supporting block h is situated so that the central longitudinal axis of supporting block h is in alignment with and directly on top of the first side edge 4 of the plywood sheet 2, such that half (the right half, in this figure) of supporting block h extends past the first side edge 4 and is uncovered by the plywood sheet 2. Supporting block h is also situated so that the central lateral axis of supporting block h is in alignment with and directly on top of the rear edge 5 of the plywood sheet 2, such that half (the bottom half, in this figure) of the supporting block extends past the rear edge 5 of the plywood sheet 2 and is uncovered by the plywood sheet 2. In other words, in this figure, only the longitudinal half of supporting block d overlies the plywood sheet 2, and only one quarter (in this figure, the top left quarter) of supporting block h overlies the plywood sheet 2.

Figure 3:
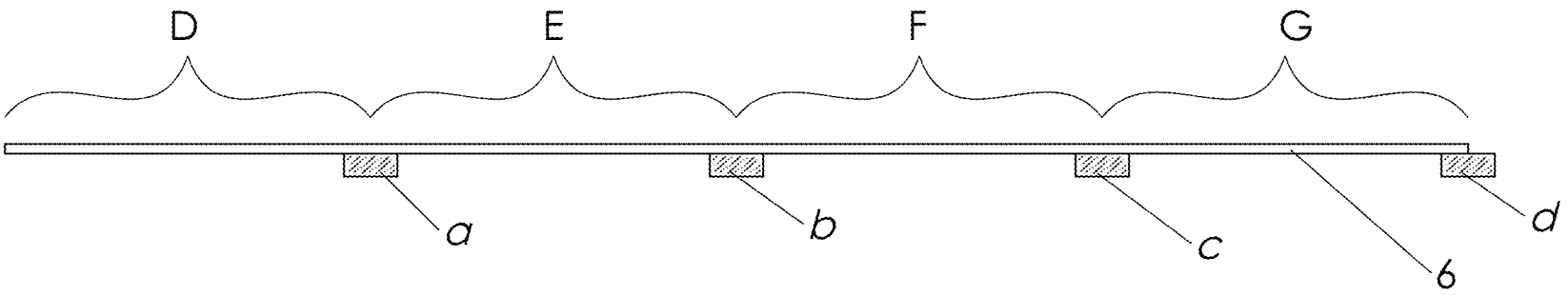
FIG. 3 is a front view of a single roof panel of the present invention.

FIG. 3 is a front view of a single roof panel of the present invention. This view is taken from the front edge 6 of the plywood sheet 2, with the front ends of supporting blocks a through d visible in this figure.

Figure 4:
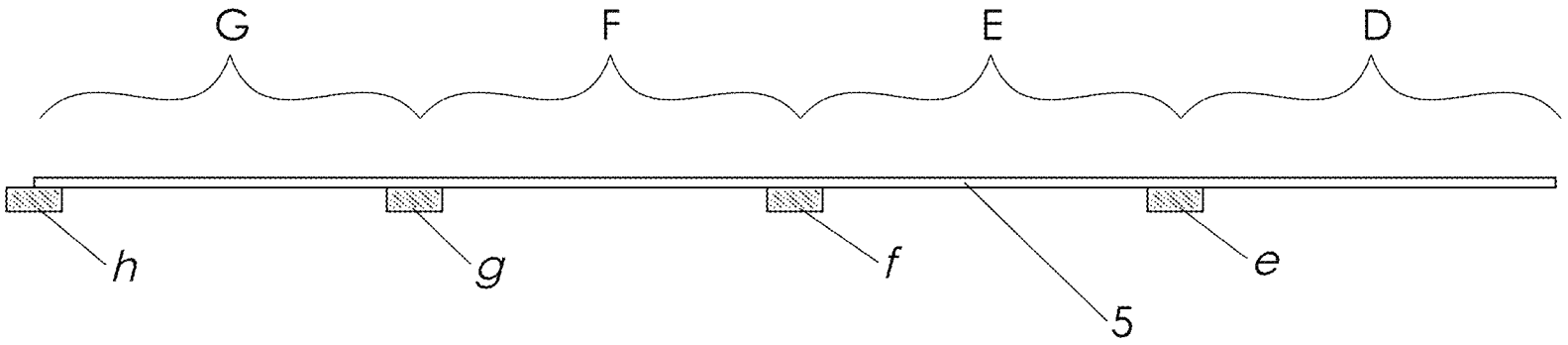
FIG. 4 is a rear view of a single roof panel of the present invention.

FIG. 4 is a rear view of a single roof panel of the present invention. This view is taken from the rear edge 5 of the plywood sheet 2, with the rear ends of supporting blocks e through h visible in this figure. Sections D-G, discussed above, are also labeled in FIGS. 3 and 4.

Figure 5:
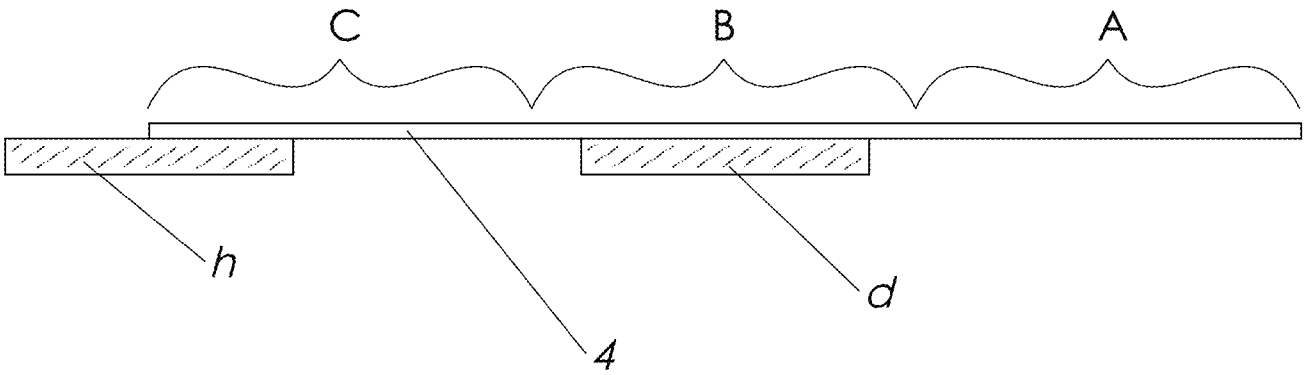
FIG. 5 is a first side view of a single roof panel of the present invention.
Figure 6:
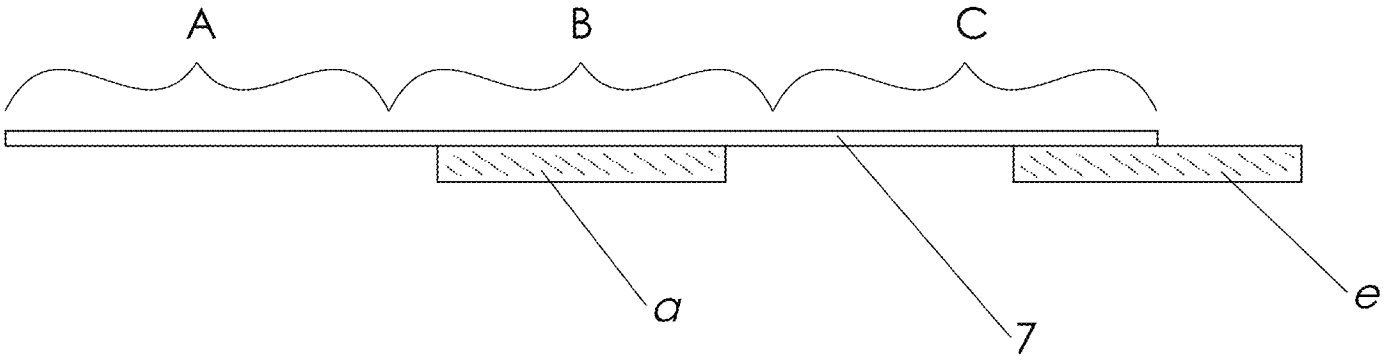
FIG. 6 is a second side view of a single roof panel of the present invention.

FIG. 5 is a first side view of a single roof panel of the present invention, and FIG. 6 is a second side view of a single roof panel of the present invention. FIG. 5 is taken from the first side edge 4 of the plywood sheet 2, and FIG. 6 is taken from the first side edge 7 of the plywood sheet 2. FIG. 3 is a front view of a single roof panel of the present invention.

FIG. 7 is a top view of a single roof panel of the present invention. In this figure, the panel 1 has been flipped from bottom to top as compared to the view shown in FIG. 2. As shown in this figure, in a preferred embodiment, the top surface of the panel 1 comprises markings that correspond to (i) the underlying supporting blocks 3 (indicated in parentheses where the supporting blocks 3 are not actually shown) and (ii) the supporting blocks 3 from adjacent panels, as explained in subsequent figures. These markings 8 facilitate the installation process.

FIG. 8 is a top perspective view of a section of roof showing the installation of the first roof panel. As shown in this figure, the first step in the method of the present invention is to secure supporting blocks 3 around the perimeter of a section of the roof. These supporting blocks 3 are preferably the same size as the supporting blocks 3 that are attached to the underside of each roof panel 1. Note that these supporting blocks 3 extend past the edge of each side of the roof for a certain distance. This is to ensure that when the roof panels 1 are placed upon these supporting blocks, the roof panels 1 will extend that same distance beyond the underlayment 9 to facilitate the installation of intake venting. The underlayment 9 may be one or more sheets of plywood, or it may be an existing shingle roof (see FIG. 13).

Next, the first roof panel 1 is situated on top of the supporting blocks that are positioned around the perimeter of the roof section, at the bottom left-hand corner of the roof section. As shown here, the reason installation of the roof panels begins at the bottom left-hand corner is because of the particular configuration of the supporting blocks 3 on the roof panel 1. These supporting blocks 3 extend beyond the outside edges of the roof panel to the top and to the right-hand side of the roof panel, creating surfaces upon which the adjacent roof panels may be positioned.

Figure 9:
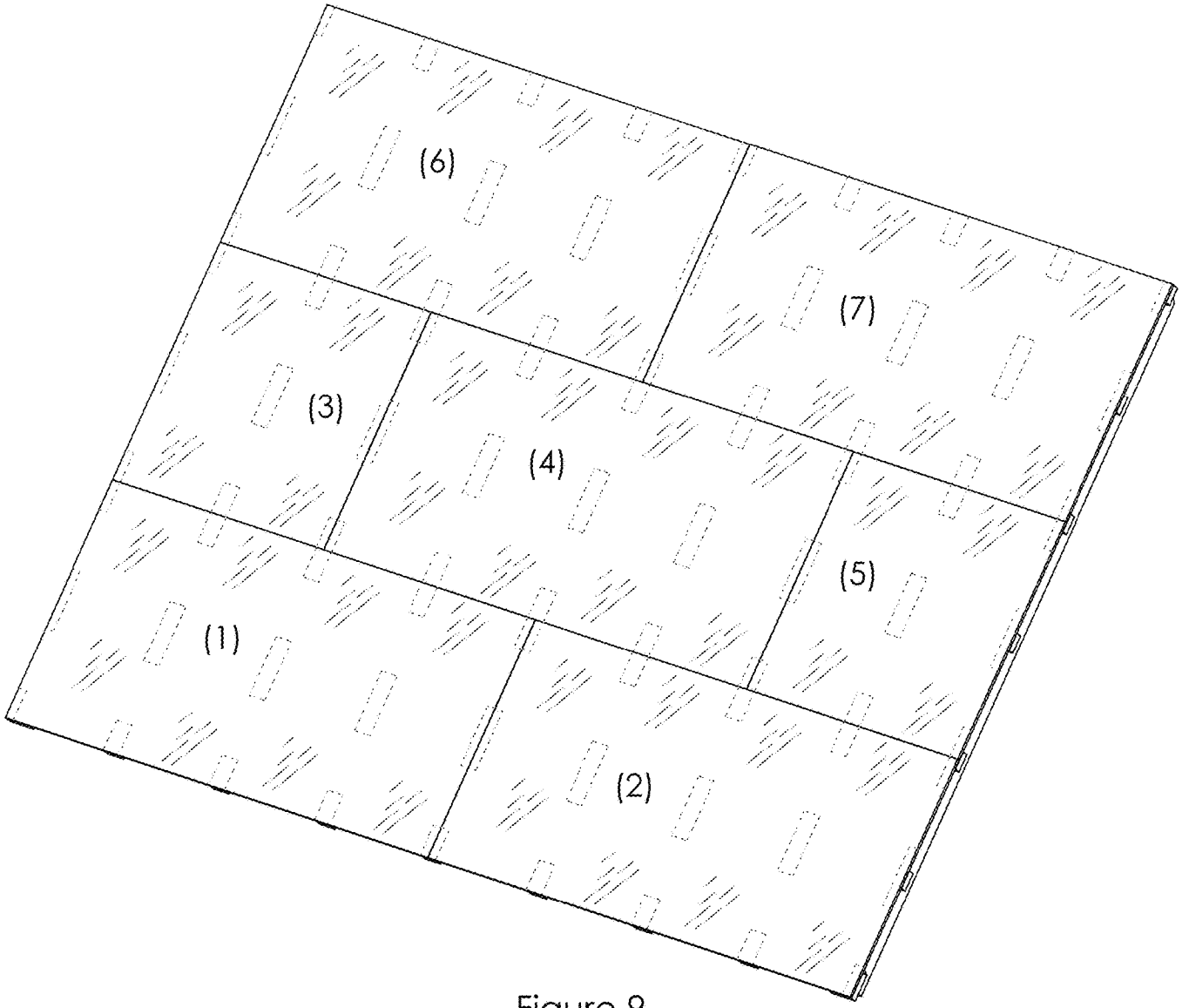
FIG. 9 is a top perspective view of a section of roof shown after all of the roof panels have been installed.

FIG. 9 is a top perspective view of a section of roof shown after all of the roof panels have been installed. The roof panels are installed in the order in which they labeled (in parentheses) in this figure. In this example, the third and fifth roof panels are cut in half so that the adjoining side edges of adjacent roof panels in one row do not align vertically with the adjoining side edges of the rows above or beneath them. In other words, the roof panels are staggered so that the side edges of the panels are offset from one row to the next. Note that the supporting blocks 3 that underlie the second, fifth and seventh panels on the right-hand side of the roof section in this example are removed so that they do not conflict with the supporting blocks 3 that are secured around the perimeter of the roof section. Similarly, the supporting blocks 3 that extend from the top edge of the sixth and seventh roof panels 1 are cut off at the top edge of the roof panel 1.

Figure 10:
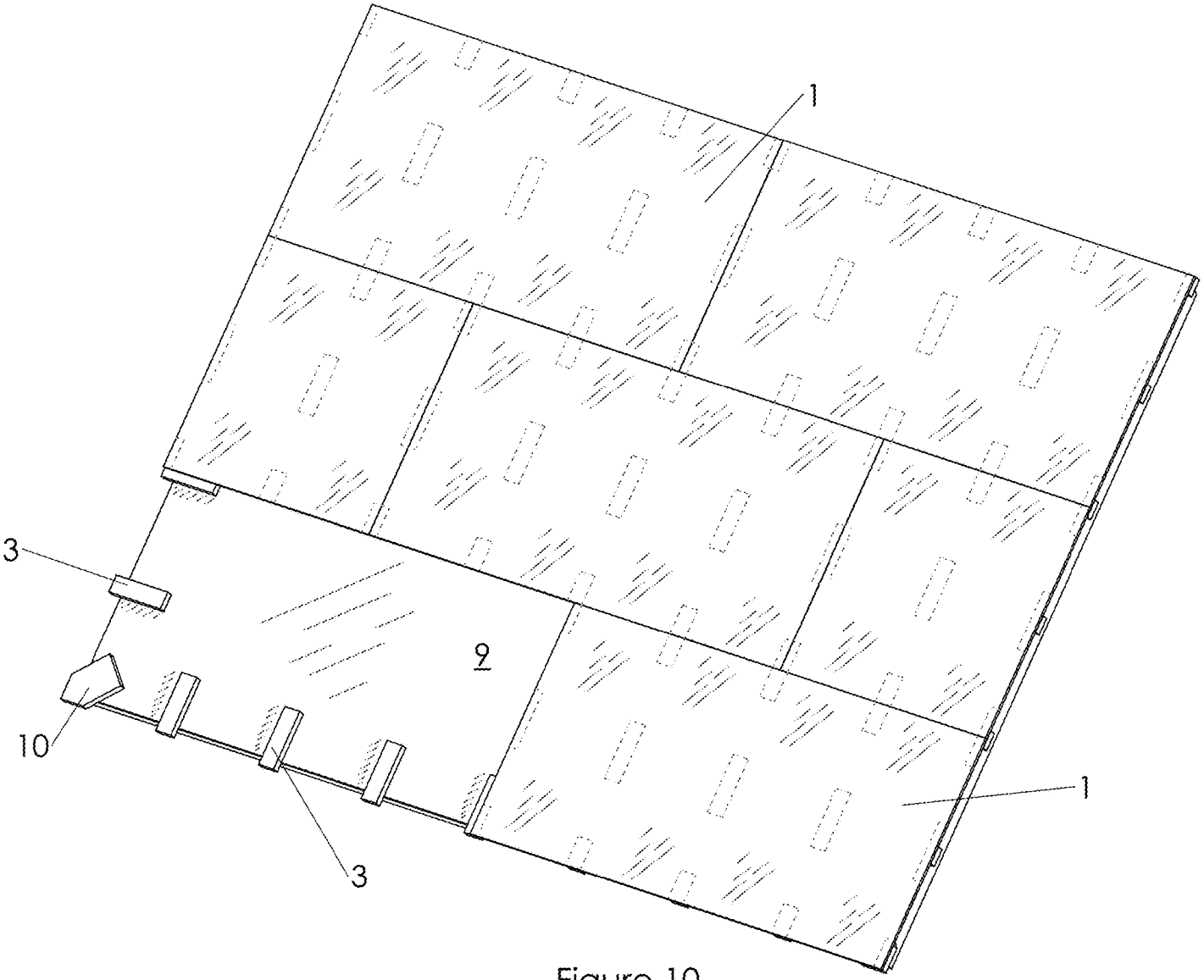
FIG. 10 is the same view as shown in FIG. 9 except with the first roof panel removed to show the underlying corner piece.

FIG. 10 is the same view as shown in FIG. 9 except with the first roof panel removed to show the underlying corner piece. The corner piece 10 is optional and may be installed at the corners of the roof section to provide additional support to the roof panel 1.

Figure 11:
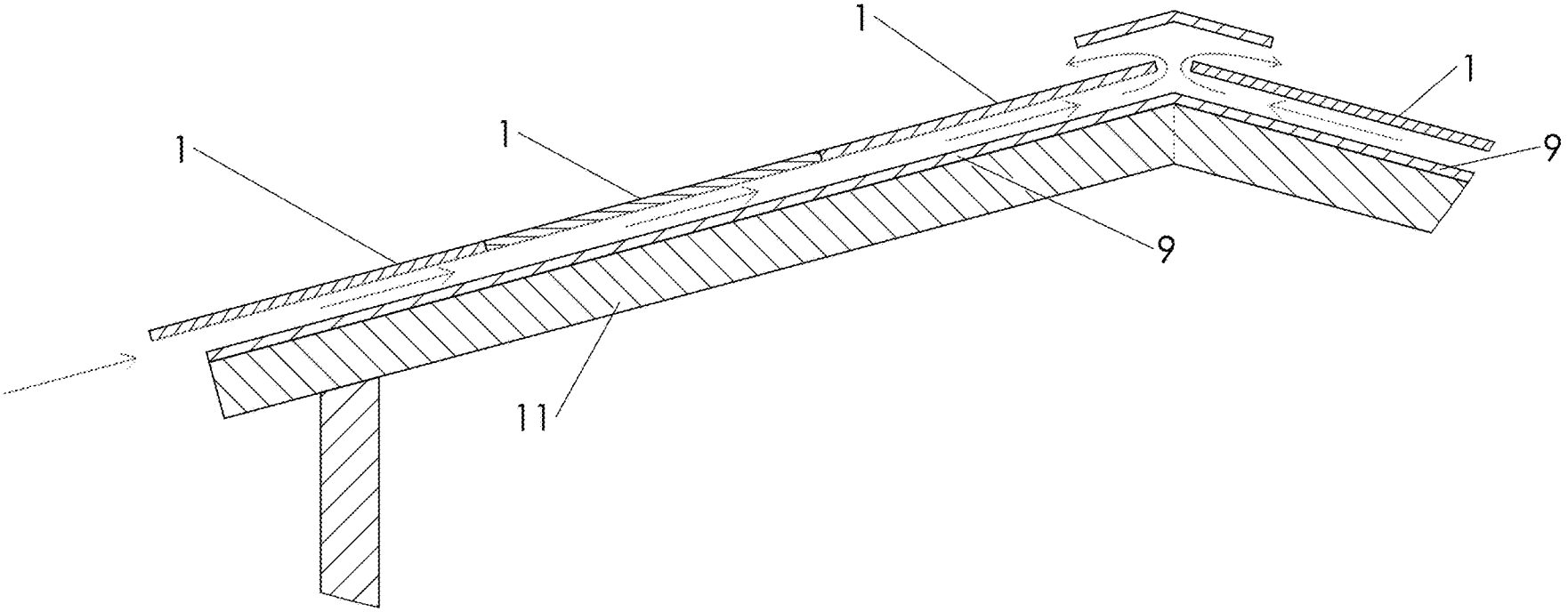
FIG. 11 is an illustration of the path of air flow in the present invention.

FIG. 11 is an illustration of the path of air flow in the present invention. The present invention maximizes air flow between the roof panels 1 and the underlayment 9. This particular figure shows air entering the system at one edge of the roof (on the left-hand side of this figure) and exiting at the top of the roof, where two roof sections meet. As noted above, in cold climates, the present invention allows heat to escape out of the roof system before it melts the underside of the snow on top of the roof, and in warm climates, it allows heat from the sun to escape from the roof system before it is absorbed into the building. A plurality of trusses 11, one of which is shown here, would typically underlie the underlayment 9 but is not part of the present invention.

Figure 12:
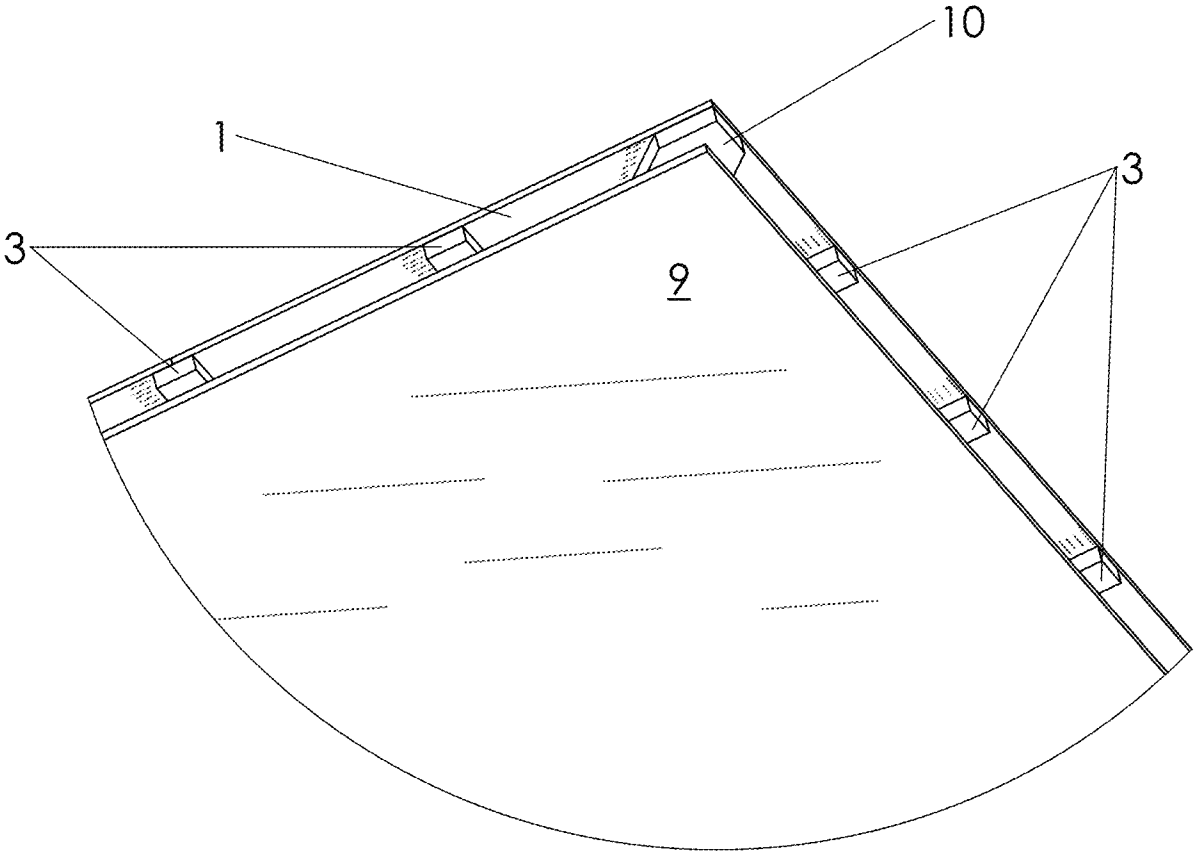
FIG. 12 is a detail view of one corner of a roof section showing the optional corner piece.

FIG. 12 is a detail view of one corner of a roof section showing the optional corner piece. This particular view is of the bottom left-hand corner of the roof section, and the roof panel shown here is the first roof panel (as numbered on FIG. 9). The supporting blocks 3 that are visible in this figure are those that are secured to the perimeter of the underlayment 9 prior to installation of the roof panel 1.

Figure 13:
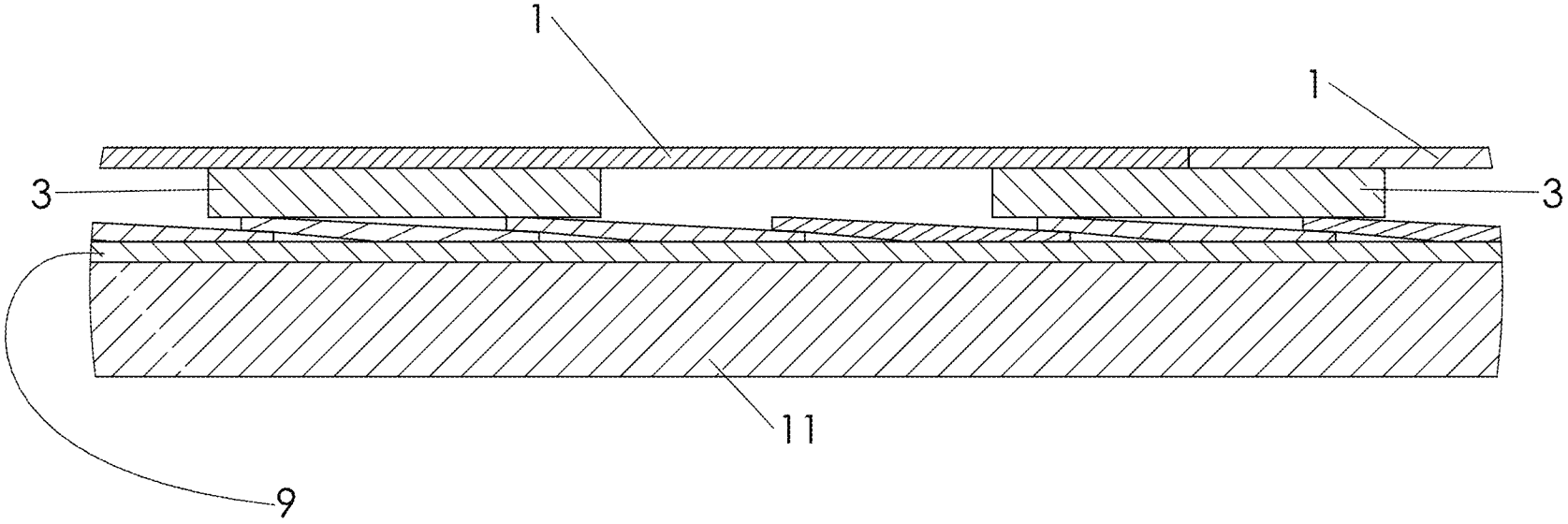
FIG. 13 is a section view of a roof showing the present invention installed on top of an existing shingle roof.

FIG. 13 is a section view of a roof showing the present invention installed on top of an existing shingle roof. In this installation, the roof panels 1 are situated on top of a layer of shingles 9. (In this example, the shingles are the underlayment.) The supporting blocks 3 shown in this figure are attached to the underside of the roof panels 1. In a preferred embodiment, the supporting blocks 3 are sized so that they always hit at least two high points on the layer of shingles 9. This ensures that the supporting blocks 3 are situated securely and will not rock or tilt on the shingles. The supporting blocks 3 must be long enough to span two points of support on the layer of shingles 9 but not so long as to diminish the free air space within the roof system (that is, the air space between the plywood 2 and the underlayment 9).

Figure 14:
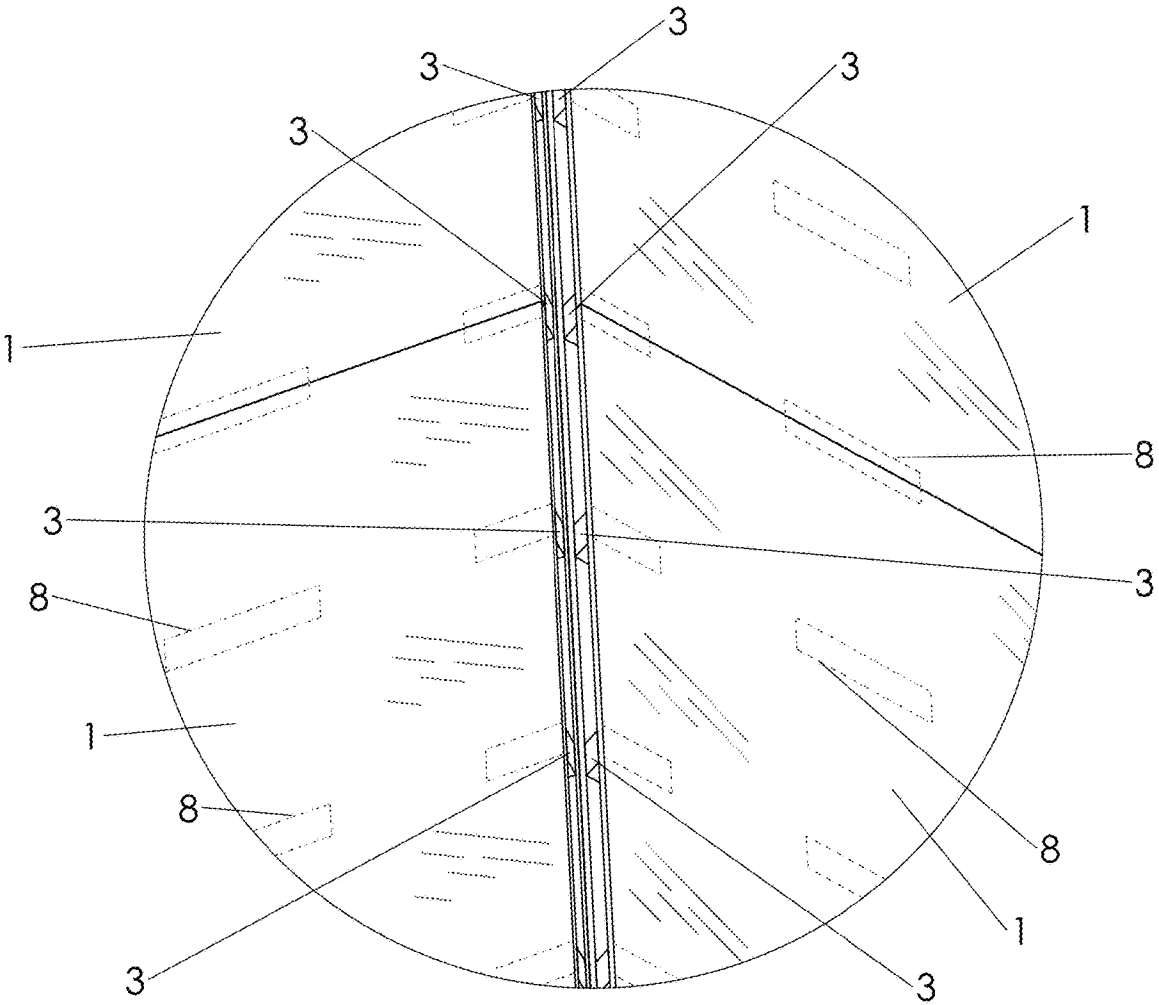
FIG. 14 is a detail view of the top part of the roofing system of the present invention.

FIG. 14 is a detail view of the top part of the roofing system of the present invention. This viewpoint is taken from the apex of the roof where the air escapes from the roofing system (see also FIG. 11). This figure also shows that the supporting blocks 3 at the top of edge of the roof are cut off where they meet the top edge of the roof panel 1.

Figure 15:
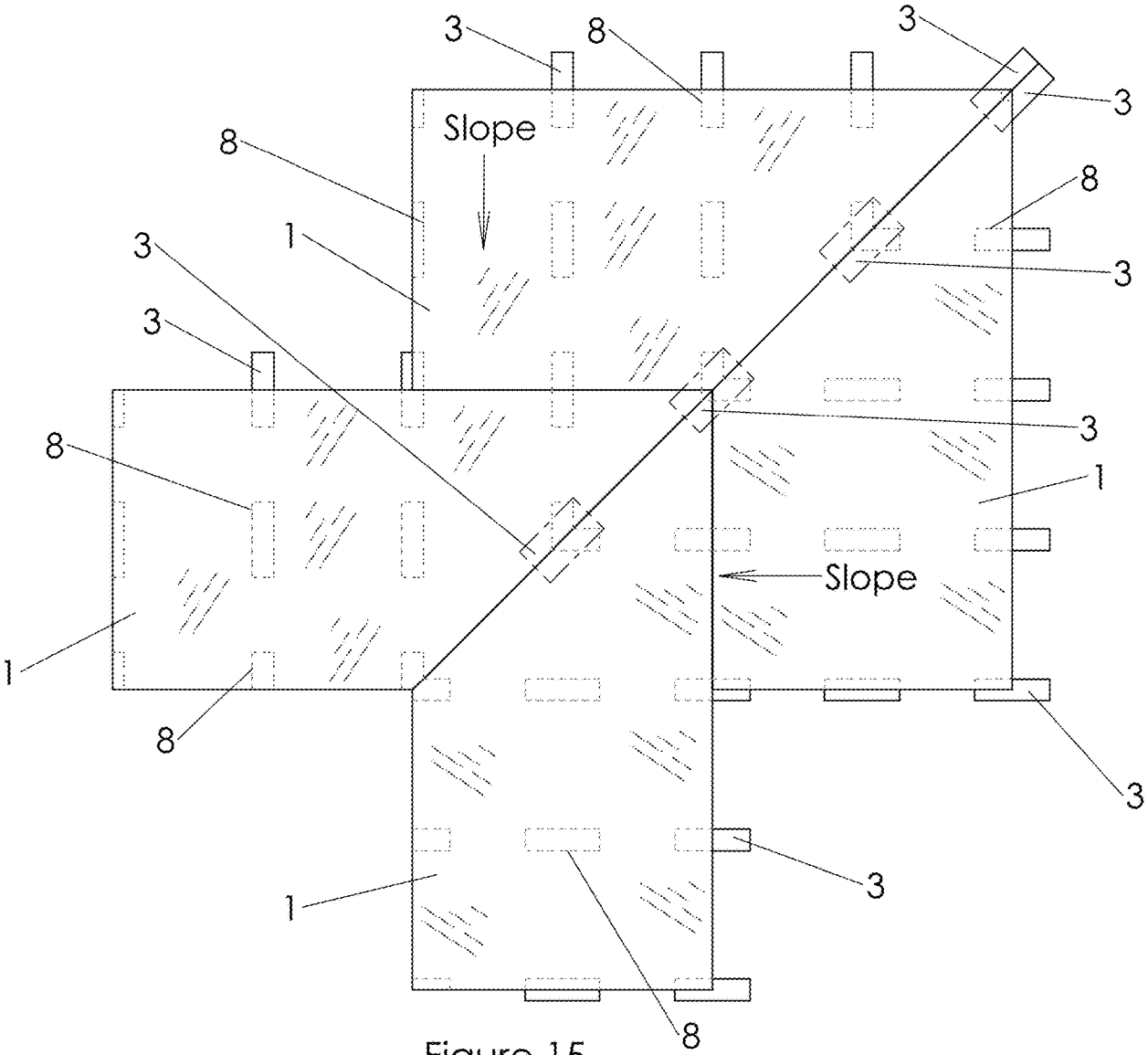
FIG. 15 is a plan view of the present invention illustrating the use of the roof panels to construct a roof valley.

FIG. 15 is a plan view of the present invention illustrating the use of the roof panels to construct a roof valley. In this figure, the slope of the roof is indicated with arrows. As shown, supporting blocks 3 are placed along the roof valley (which runs from top right to bottom left in this figure), and one half section of each of the roof panels 1 (there are four in this illustration) is cut along a forty-five-degree (45°) angle to configure the roof valley. Note that the supporting blocks 3 underlie some of the markings 8 in this figure.

As compared to conventional cross-framed cold roofs, the present invention greatly reduces the amount of blocking material required. As compared to insulated cold roof panels, the present invention increases the net free air space along the eaves, which maximizes the total amount of airflow that enters the cold roof cavity. The present invention also provides that the edges of each roof panel are supported and flush with one another. The markings on the roof panels allow for quick and accurate installation and ensure that the panels are nailed onto the underlayment directly through the supporting blocks. In a preferred embodiment, the roof panels are fastened to the underlayment using three 3.5" ring shank framing nails through each marking on the top of each panel.

Conventional cross-framed cold roof's are expensive, use a lot of lumber, and are time-consuming to install. Insulated cold roof panels are typically more expensive than conventional cross-framed cold roofs and require an additional layer of fascia to cover the panel edges. The present invention overcomes the disadvantages of both of these types of roofing systems and is designed to maximize airflow while maintaining the necessary structural support.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A method of installing a cross-ventilated cold roof system comprising:

(a) installing a plurality of supporting blocks around a perimeter of a section of roof;

(b) installing the plurality of roof panels in a plurality of rows;

wherein each roof panel is comprised of a plywood sheet and eight supporting blocks that are fixedly attached to an underside of the plywood sheet;

wherein the supporting blocks are arranged on the underside of the plywood sheet as follows:

wherein each roof panel is divided longitudinally into three equal longitudinal sections, a first longitudinal section being situated across a front end of the roof panel, a second longitudinal section being situated across a center of the roof panel, and a third longitudinal section being situated across a rear end of the roof panel:

wherein four supporting blocks are attached to the underside of the plywood sheet in the second longitudinal section;

wherein four supporting blocks are attached to the underside of the plywood sheet in the third longitudinal section such that a first half of each supporting block measured along a lateral axis of the supporting block is attached to the underside of the plywood sheet and a second half of each supporting block measured along the lateral axis of the supporting block extends outwardly from a rear edge of the roof panel;

wherein each roof panel is divided laterally into four equal lateral sections, a first lateral section being situated along a first side edge of the roof panel, a second lateral section being situated adjacent to the first lateral section, a third lateral section being situated adjacent to the second lateral section, and a fourth lateral section being situated along a second side edge of the roof panel;

wherein three of the four supporting blocks that are situated in the second longitudinal section are situated along a dividing line between adjacent lateral sections, and a fourth block of the four supporting blocks that are situated in the second longitudinal section is situated such that a longitudinal axis of the fourth block in the second longitudinal section is aligned with the second side edge of the roof panel; and wherein three of the four supporting blocks that are situated in the third longitudinal section are situated along a dividing line between adjacent lateral sections, and a fourth block of the four supporting blocks that are situated in the third longitudinal section is situated such that a longitudinal axis of the fourth block in the third longitudinal section is aligned with the second side edge of the roof panel;

(c) staggering the rows of roof panels so that adjacent side edges of the roof panels are offset in one row relative to an adjoining row; and (d) removing supporting blocks from the plurality of roof panels as needed to avoid overlap with the supporting blocks around the perimeter of the section of roof.

2. The method of claim 1, wherein an underlayment with outer edges underlies the plurality of supporting blocks; and wherein the supporting blocks that are arranged around the perimeter of the section of roof extend beyond the outer edges of the under underlayment.

3. The method of claim 2, wherein the underlayment is a layer of shingles comprised of a series of high points; and wherein the supporting blocks that are fixedly attached to the underside of the plywood sheet are configured to span at least two high points on the layer of shingles.

4. The method of claim 1, further comprising:

(e) installing a plurality of supporting blocks along a roof valley;

(f) providing a plurality of the roof panels of claim 1 for installation along the roof valley;

(g) wherein each of the plurality of the roof panels of claim 1 that is provided for installation along the roof valley comprises a first half and a second half, cutting the first half of each of the roof panels along a forty-five-degree angle; and (h) installing the cut roof panels along the roof valley.

* * * * *